United States Patent [19]

Galmiche

[11] Patent Number: 4,608,930

[45] Date of Patent: Sep. 2, 1986

[54] CABLEWAY WITH TRANSPORT PATH HAVING ONE OR MORE LATERAL INFLECTION POINTS

[75] Inventor: Jean-Marie Galmiche, Echirolles, France

[73] Assignee: Societe Anonyme Dite: Etablissements Montaz-Mautino, Fontaine, France

[21] Appl. No.: 379,889

[22] Filed: May 19, 1982

[30] Foreign Application Priority Data

May 20, 1981 [FR] France ..... 81 10381

[51] Int. Cl.[4] ..... B61B 7/04

[52] U.S. Cl. ..... 104/180; 104/87; 104/189; 104/191; 104/202

[58] Field of Search ..... 104/87, 115, 116, 173 R, 104/173 ST, 180, 189, 191, 197, 198, 199, 200, 202, 209, 214, 215, 216

[56] References Cited

U.S. PATENT DOCUMENTS

| | | | |
|---|---|---|---|
| 861,818 | 7/1907 | Drake | 104/180 |
| 885,455 | 4/1908 | Drake | 104/191 |
| 923,337 | 6/1909 | Cowley | 104/191 X |
| 959,595 | 5/1910 | Pfaffenbach | 104/191 X |
| 1,154,652 | 9/1915 | Norris | 104/191 |
| 3,218,988 | 11/1965 | Gaston et al. | 104/191 |
| 3,429,279 | 2/1969 | Pomagalski | 104/173 R |

FOREIGN PATENT DOCUMENTS

| | | | |
|---|---|---|---|
| 2241979 | 3/1974 | Fed. Rep. of Germany | 104/189 |
| 163208 | 11/1903 | Fed. Rep. of Germany | 104/191 |
| 2011949 | 10/1971 | Fed. Rep. of Germany | 104/173 R |
| 245262 | 10/1946 | Switzerland | 104/216 |
| 873921 | 8/1961 | United Kingdom | 104/173 R |

*Primary Examiner*—Randolph A. Reese

*Attorney, Agent, or Firm*—Karl F. Ross; Herbert Dubno

[57] ABSTRACT

A cableway-type transportation system has an endless cable looped under tension about two reversing pulleys between which its two substantially parallel runs are supported by sustaining rollers yieldably overlain by retaining rollers. At an intermediate point the two runs are laterally bent in the same direction by respective deflectors lying within the loop plane, namely a first deflector comprising a relatively large pulley inside the loop and a second deflector including an array of relatively small pulleys outside the loop. The latter pulleys are partly overlain by a curved shelf rigid with a vertical web of a guard rail, the corresponding cable run passing normally under that web. Loads carried by the cable are connected therewith by generally C-shaped suspensions including cable clamps, each clamp having a movable jaw surrounding the engaged cable portion on three sides and a fixed jaw carrying rollers which coact with the web of the guard rail to detach the engaged cable portion from the array of deflecting pulleys in order to let the load suspension move past. The clamp also carries a roller riding on the shelf during such passage to support the load. The movable clamp jaw temporarily separates the engaged cable portion from any of the other pulleys encountered thereby; tapering fingers on that jaw coact with the over- and underlying retaining and sustaining pulleys to provide guidance during such separation.

5 Claims, 8 Drawing Figures

CABLEWAY WITH TRANSPORT PATH HAVING ONE OR MORE LATERAL INFLECTION POINTS

FIELD OF THE INVENTION

My present invention relates to a transportation system with loads suspended from an endless cable, such as an aerial tramway or a ski lift, referred to hereinafter as a cableway.

BACKGROUND OF THE INVENTION

Conventional systems of this type include a cable loop with substantially parallel runs wound about two reversing pulleys, one of them driven while the other may be limitedly displaceable in the direction of these runs under a biasing force tending to tension the cable. Upright pylons or posts are installed throughout the length of the loop to carry sustaining pulleys with generally horizontal axes supporting the cable at intermediate locations. The loop may lie in a horizontal or an inclined plane and could also be divided into sections of different slope by curving about such pulleys.

Loads, e.g. cabins or chairs, are secured to the cable—usually in balanced pairs—with the aid of generally C-shaped suspensions, including cable-gripping clamps, maintaining the center of gravity of each load more or less directly below the cable; these suspensions have stems which in many instances are swivelable about a transverse horizontal axis and are laterally outwardly offset from the cable loop in order to clear the cable-engaging pulleys and their posts. In such systems it is often necessary to bend the cable loop laterally at one or more deflection points, e.g. in order to avoid obstacles on the terrain or to provide convenient access at intermediate stations. To this end, deflection pulleys can be readily placed in contact with a run of the cable on the inside of its loop without interfering with the outwardly offset load suspension. Problems arise, however, when the two runs are to be bent parallel to each other, since one run would then have to be deflected by an outside pulley or guide member lying in the path of the suspensions.

Thus, the runs of the loops of conventional cableways either lie in parallel vertical planes or deviate from each other so as to bend only about deflectors disposed inside the loop.

OBJECT OF THE INVENTION

The object of my present invention, therefore, is to provide a cableway with one or more lateral bends in its path yet with maintainance of substantial parallelism between the two runs of the cable loop.

SUMMARY OF THE INVENTION

In accordance with my invention I provide a cableway of the general type referred to with first and second deflecting means respectively engaging one run of the cable from inside its loop and the other, substantially parallel run from outside the loop so as to impart substantially coplanar bends to these runs with centers of curvature on the same side of the loop. On a level above the suspension means carrying a load to be transported, the externally disposed second deflecting means has a guard member normally projecting past the respective run of the cable. At least one of the jaws of the cable-gripping clamp of the suspension means surrounding the engaged cable portion separates same from the reversing and sustaining pulleys, during its traverse of the opposite loop ends and of the aforementioned intermediate locations, and from the internally disposed first deflecting means upon passage of the clamp through the corresponding bend. The clamp is further provided with rollers engageable with the guard member upon an approach of the other bend for temporarily detaching the cable from the second deflecting means while guiding the suspension means past the second deflecting means. The cable must also be provided with suitable tensioning means insuring its re-engagement with the pulleys from which it has been temporarily separated.

The guard member, according to a more particular feature of my invention, is a rail having a vertical web advantageously provided with an overlying shelf and curved in the plane of the loop so that a lateral roller on the clamp can ride on the shelf for supporting the suspension means during the temporary detachment of the cable from the external deflecting means.

When the sustaining pulleys are overlain by retaining pulleys separable therefrom against a downwardly acting biasing force, such as that of a strong spring, the clamp may be provided with forwardly and rearwardly projecting pairs of tapered fingers closely overlying and underlying the cable for positively engaging the retaining and the sustaining pulleys while separating them from the cable over an extended distance in front and in back of the clamp.

A further feature of my invention resides in the provision of ancillary pulleys engaging the inwardly bent run of the cable from inside the loop in the plane thereof upstream and downstream of the second deflecting means, between the latter and the nearest sustaining pulleys, for preventing any separation of the cable from these latter pulleys during travel of the clamp past the second deflecting means.

BRIEF DESCRIPTION OF THE DRAWING

These and other features of my invention will now be described in detail with reference to the accompanying drawing wherein.

SPECIFIC DESCRIPTION

Figure 1:
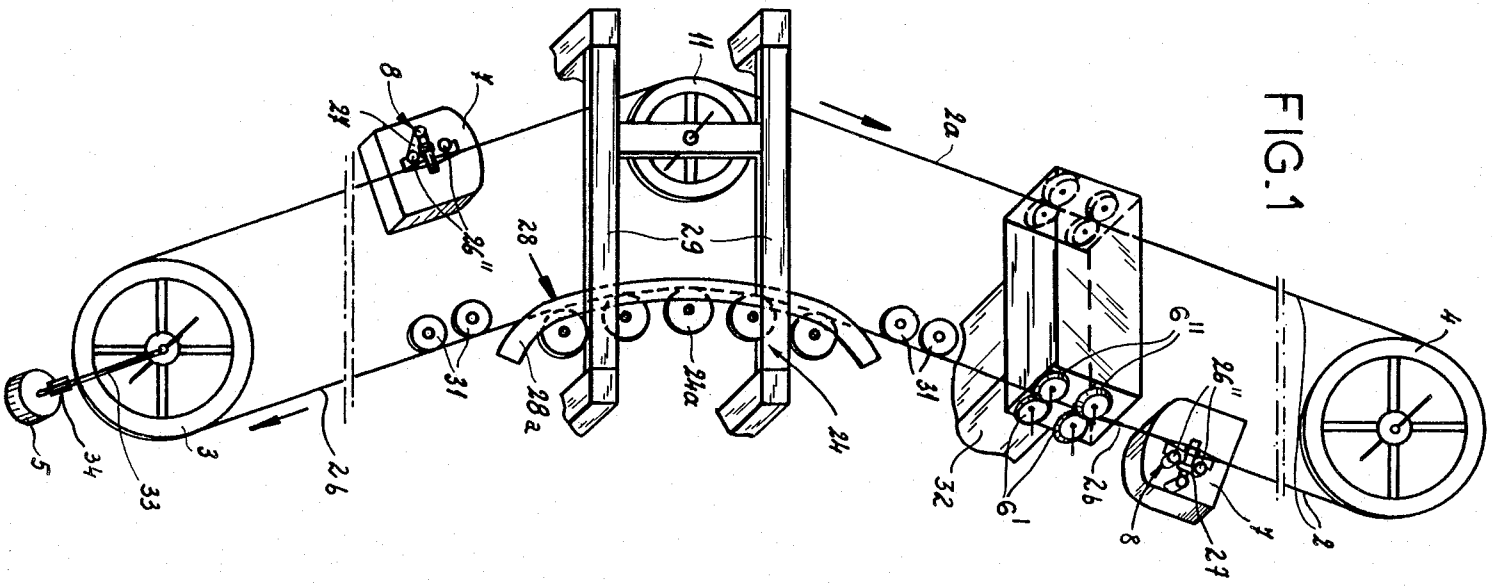
FIG. 1 is a diagrammatical plan view of a cableway according to my invention.
Figure 2:
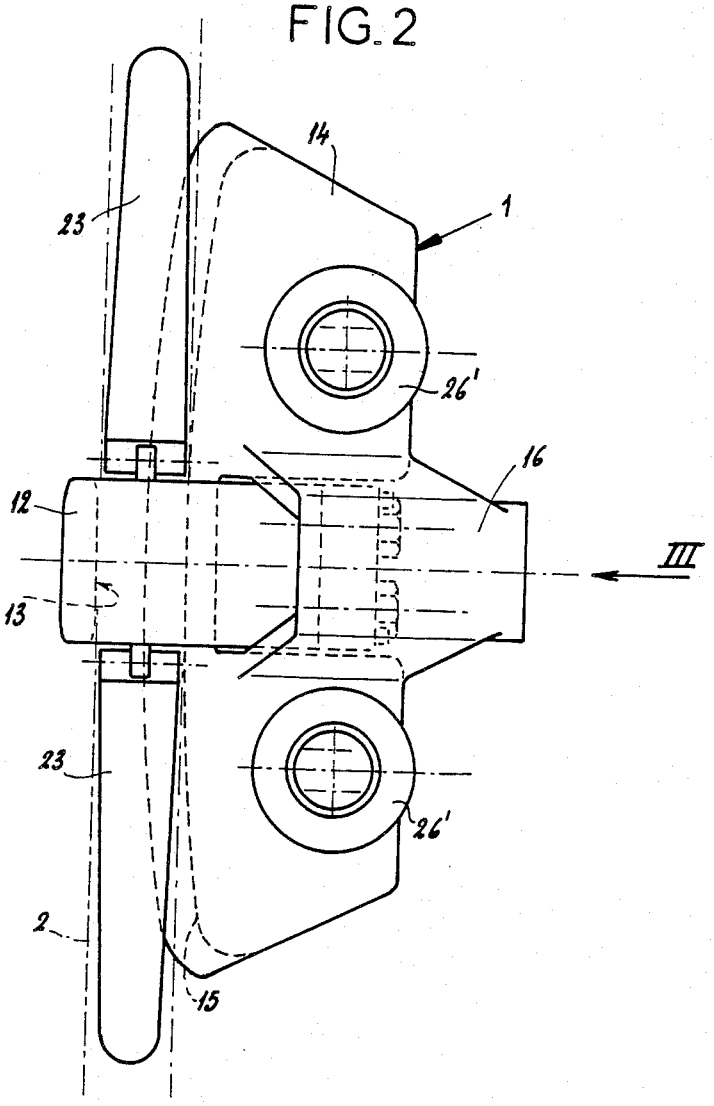
FIG. 2 is a bottom view, drawn to a larger scale, of a cable-gripping clamp forming part of a load-carrying suspension in the system of FIG. 1.
Figure 3:
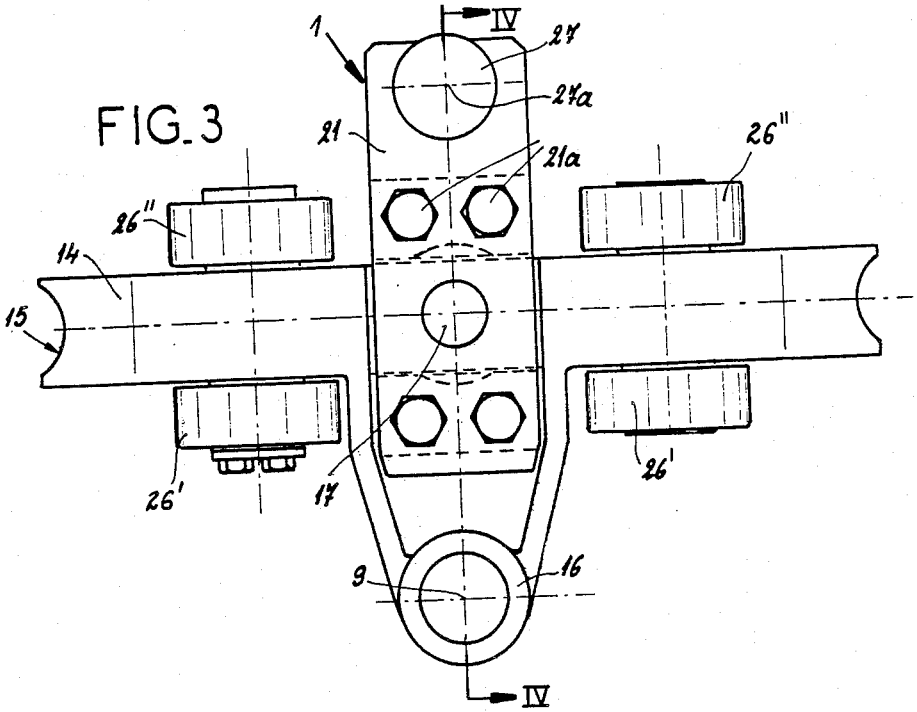
FIG. 3 is a side-elevational view of the cable-gripping clamp taken in the direction of the arrow III of FIG. 2.
Figure 4:
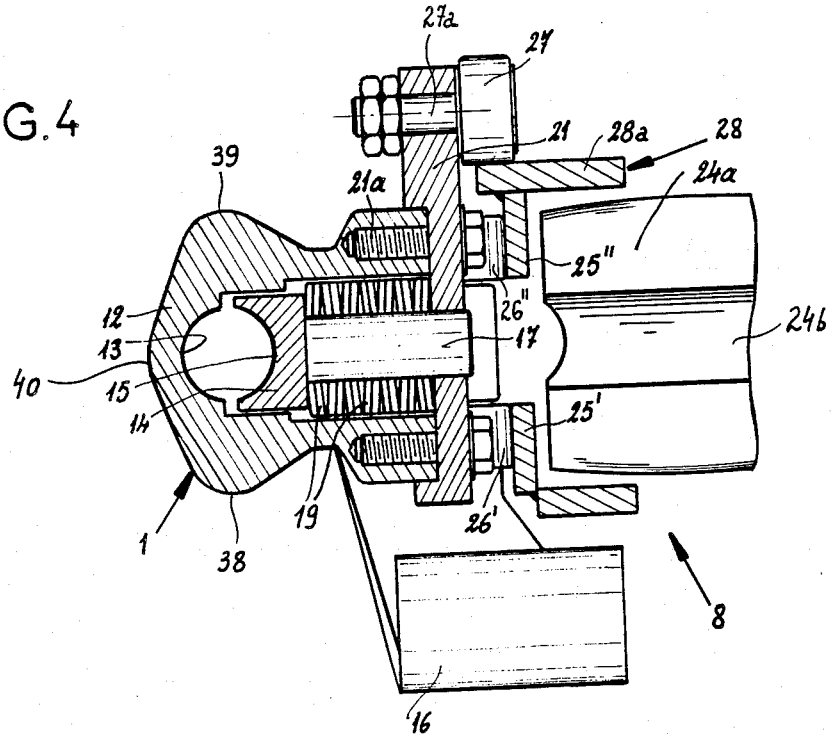
FIG. 4 is a cross-sectional view of the clamp moving past an inner deflecting pulley, taken substantially along the line IV—IV of FIG. 3.
Figure 5:
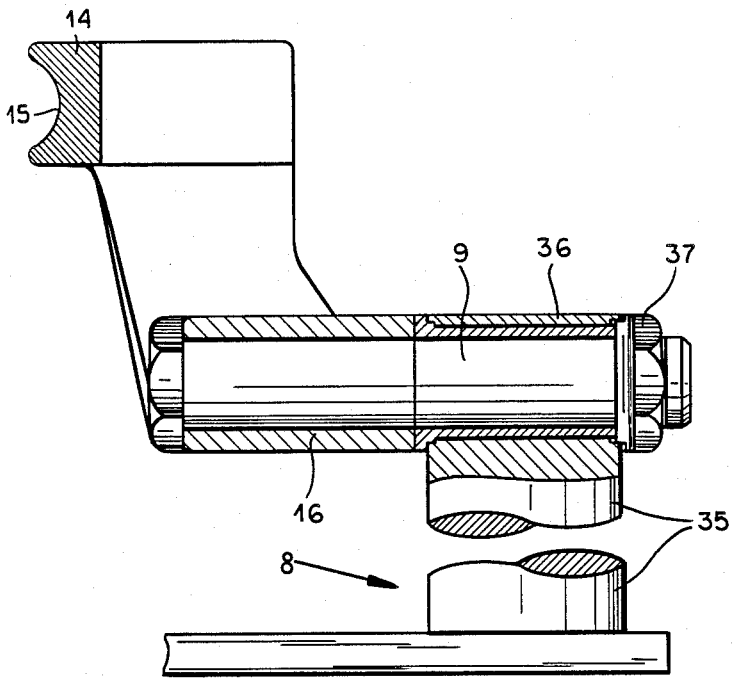
FIG. 5 is an elevational view, partly in section, of a movable gripping jaw of the clamp shown in FIGS. 2 through 4.
Figure 6:
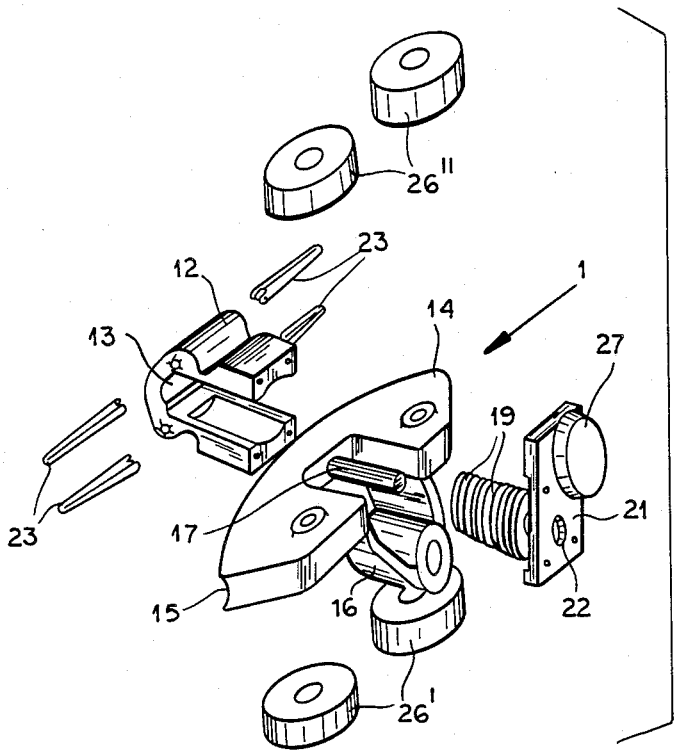
FIG. 6 is an exploded perspective view of the cable-gripping clamp shown in FIGS. 2 through 5.

A transportation system according to my invention, as shown in FIG. 1, comprises an endless cable 2 with parallel runs 2*a*, 2*b* wound around two reversing pulleys 3 and 4 at opposite ends of its loop, e.g. at a lower and an upper station (not further illustrated) of a funicular installed on a mountainside. The lower pulley 3 has a shaft with bearings slidable parallel to the cable runs which are linked with a counterweight 5 by a rope or chain 33 led around a pulley 34, thereby creating a biasing force to tension the cable 2. One of these pulleys is coupled with a nonillustrated, preferably reversible drive motor for setting it in rotation, e.g. clockwise as indicated by arrows in FIG. 1, whenever passengers or goods are to be transported.

The cable 2 is additionally supported, at intermediate locations along its loop, by several sustaining pulleys 6' with horizontal axes which are mounted on upright pylons 32 (only one shown) within the confines of the cable loop. The sustaining pulleys 6' are overlain by respective retaining pulleys 6" with shafts journaled in bearings that are upwardly displaceable perpendicularly to the loop plane, against the resistance of nonillustrated restraining springs, so as to enable a limited separation of pulleys 6' and 6" from each other for reasons which will presently become apparent.

At least one pair of loads 7, here shown as passenger cabins, are carried by the cable 2 at regular intervals with the aid of generally C-shaped suspensions 8 including cable-gripping clamps 1 (see FIGS. 2–6). The cabins 7 are transported from the bottom station to the top station on the ascending run **2*a* of the cable and back on its decending run 2*b*; these runs ae respectively deflected by a large-diameter pulley 11 inside the loop and by an array 24 of small-diameter pulleys 24*a* outside the loop to form two coplanar bends with centers of curvature to the right of the loop as viewed in FIG. 1. The deflecting pulleys 11, 24*a* have fixed axes of rotation and are mounted on an overhead structure, comprising two portal frames 29, also carrying a guard rail 28 with lower and upper vertical webs 25', 25" (see FIG. 4) substantially conforming to the curvature of array 24. The webs 25', 25" straddle grooves 24*b* of pulleys 24*a* and are spaced apart by a clearance accommodating the cable run 2*b* normally engaging in these grooves. Web 25" is rigid with a shelf 28*a*, paralleling the loop plane, which partly overlies the pulleys 24*a*** on the loop side.

The clamp 1 shown in FIGS. 2–6 comprises a fixed jaw 14 and a movable jaw 12 with respective grooves 15 and 13 gripping the cable under the pressure of a stack of Belleville springs 19. The fixed jaw 14 has a pin 17 passing through the Belleville springs 19 and through an aperture 22 (FIG. 6) in a backing plate 21 attached to the movable jaw 12 by screws **21*a*. Jaw 14 carries pairs of lower and upper rollers 26', 26" cammingly engageable with webs 25', 25" upon encountering their more sharply curved extremities, thereby forcing the entire suspension 8 with its load 7 and the engaged cable portion to the left as viewed in FIGS. 1 and 4. A roller 27, secured to an upper portion of plate 21 by a stub shaft 27*a*, simultaneously comes to bear upon the shelf 28*a* to support the weight of the load and to maintain the engaged cable portion on the level of grooves 24*b*. The fixed clamp jaw 14 carries a hub 16 traversed by a threaded horizontal stub 9 (FIG. 5) on which a load-supporting stem 35 forming part of the C-shaped suspension 8 is swivelably mounted by means of a bushing 36 and a nut 37**.

Figure 7:
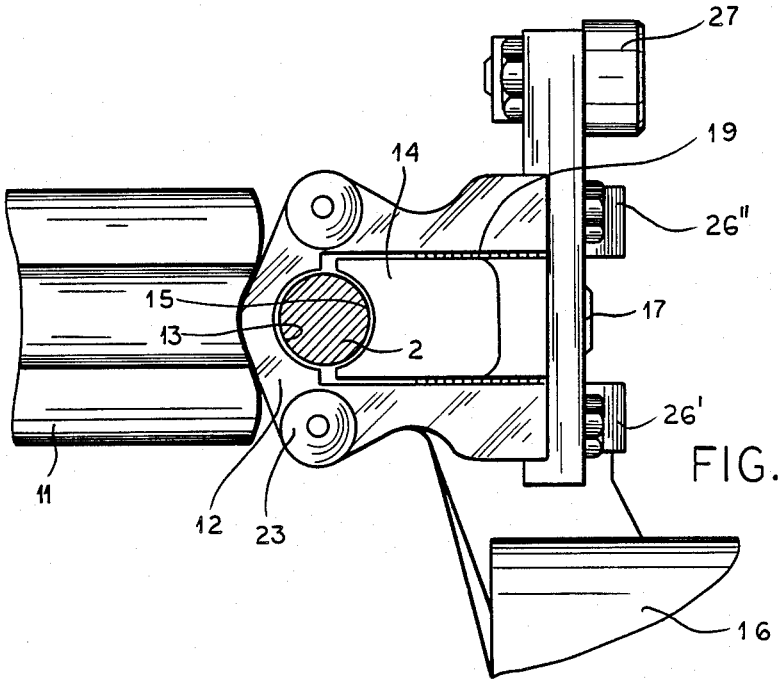
FIG. 7 is a partly sectional view generally similar to FIG. 4, showing the clamp moving past a deflecting pulley.
Figure 8:
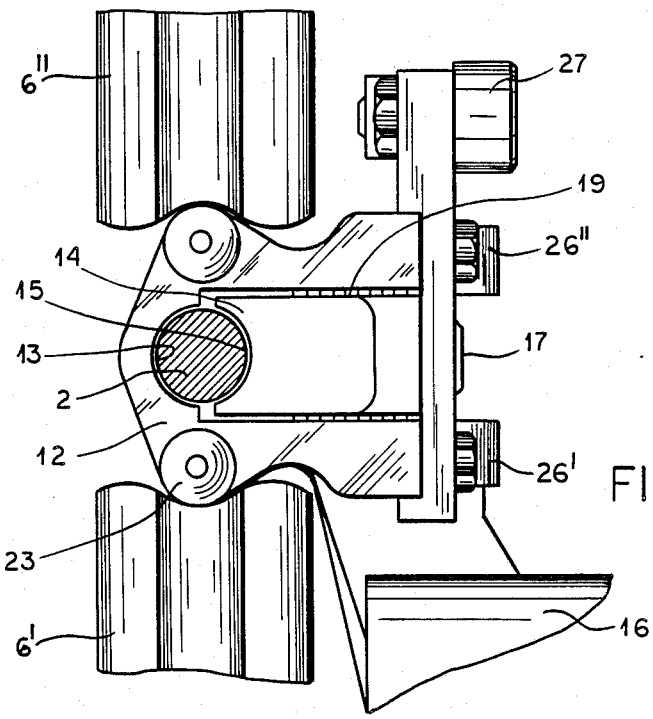
FIG. 8 is a view similar to FIG. 7, showing the clamp in its passage between a sustaining and a retaining pulley.

The movable jaw 12, surrounding the engaged cable portion on three sides, has a rounded contour with a lower hump 38, an upper hump 39 and a lateral hump 40; humps 38 and 39 are respectively receivable in the cable-engaging grooves of sustaining pulleys 6' and retaining pulleys 6", as seen in FIG. 8, whereas hump 40 is receivable in a groove of deflecting pulley 11 (see FIG. 7) as well as in grooves of reversing pulleys 3 and 4. This jaw 12 is further provided with forwardly and rearwardly projecting pairs of vertically superposed tapering fingers 23 which are articulated thereto for limited pivoting about horizontal axes and are urged by springs (not shown) into contact with the cable 2. The rounded free ends of fingers 23 allow the fingers of the leading pair to wedge themselves between the cable and a pulley pair 6', 6" approached by the clamp; the four fingers also serve as temporary clamp guides by engaging in the grooves of pulleys 6', 6" while the cable is detached therefrom for a certain distance upstream and downstream of jaw 12, as seen in FIG. 8. This distance should be less than the spacing of adjacent pulley pairs 6', 6" for improved guidance.

As long as the nearest vertical pulleys 6', 6" are remote from the deflecting array 24, the inward deviation of the cable run **2*b* from its normal path during passage of a load through the bend will have no significant effect upon the engagement of these pulleys with the cable. When, however, such pulleys lie close to that array, the shift of the cable run may be sufficient to separate the cable from the pulley pair 6', 6" especially on the downstream side of the bend. In order to prevent such a mishap, I prefer to provide one or more ancillary pulleys 31 disposed within the loop immediately ahead of and beyond the deflector as shown in FIG. 1. The presence of these ancillary pulleys also enhances the effect of the cable tension, due to counterweight 5, in re-engaging the run 2*b* with the pulleys 24*a* after the load suspension 8 has moved past. The lateral hump 40 of clamp 1, of course, coacts with pulleys 31 in the same way as with pulleys 3, 4 and 11**.

The symmetrical arrangement of the deflector, the ancillary pulleys 31 and the wedge members 23 allow the system of FIG. 1 to operate both in the indicated clockwise direction and in the reverse sense. Naturally, there could be several deflecting units 11, 24, 28 along the cable loop, some of them possibly facing in the opposite direction to define a zig-zagging transport path; also, biasing means other than a counterweight could be used for tensioning the cable. The cable loop could be substantially horizontal instead of inclined, e.g. for urban transportation.

I claim:

1. In a transportation system with an endless cable wound under tension in a loop around two reversing pulleys at opposite ends of the loop, at least one of said reversing pulleys being driven, said loop forming two substantially parallel runs supported at intermediate locations by sustaining pulleys with axes substantially parallel to a plane defined by said runs, said reversing and sustaining pulleys being held above the ground by overhead mountings, and with at least one load carried on said cable by suspension means including a cable-gripping clamp projecting laterally outward from said loop to avoid said mountings, the combination therewith of first and second deflecting means laterally engaging one of said runs from inside the loop and the other of said runs from outside the loop, respectively, for imparting substantially coplanar bends to said runs with centers of curvature on the same side of the loop, said second deflecting means being provided with a stationary guard rail with a substantially vertical web normally projecting past said other of said runs on a level above said suspension means with a curvature in the plane of the loop conforming to the bend of said other of said runs and with at least one more sharply curved extremity, said clamp having jaw means surrounding an engaged cable portion for separating same from said reversing and sustaining pulleys and from said first deflecting means upon passage through said opposite ends, said intermediate locations and the bend of said one of said runs, said clamp being further provided with roller means parallel to said plane engageable with the web of said guard rail upon encountering said more sharply curved extremity thereof on an approach of the bend of said other of said runs for temporarily detaching said cable from said second deflecting means while guiding said suspension means past said second deflecting means, said guard rail being provided with a shelf overlying said web, said clamp further carrying a lateral roller positioned to ride on said shelf for supporting said suspension means during the temporary detachment of said cable from said second deflecting means.

2. The combination defined in claim 1 wherein said sustaining pulleys are overlain by respective retaining pulleys separable therefrom against a downwardly acting biasing force, said jaw means being provided with a lower hump, an upper hump and a lateral hump respectively engageable with said sustaining pulleys, said retaining pulleys and said first deflecting means.

3. The combination combined in claim 2 wherein said clamp is provided with forwardly and rearwardly projecting pairs of tapering fingers closely overlying and underlying said cable for positively engaging said retaining and sustaining pulleys while holding said cable separated therefrom.

4. The combination defined in claim 1, 2 or 3, further comprising ancillary pulleys engaging said other of said runs from inside the loop in the plane thereof upstream and downstream of said second deflecting means, between said second deflecting means and the nearest sustaining pulleys, for preventing separation of the cable from the last-mentioned pulleys during travel of said clamp past said second deflecting means.

5. The combination defined in claim 1, 2 or 3 wherein said first deflecting means comprises a large-diameter pulley and said second deflecting means comprises a row of small-diameter pulleys in the plane of said loop rotatable about fixed axes perpendicular to said plane.

* * * * *